US008869468B2

(12) United States Patent
Hinchman

(10) Patent No.: US 8,869,468 B2
(45) **Date of Patent: *Oct. 28, 2014**

(54) BUCKLING-RESTRAINED BRACE

(71) Applicant: Andrew Hinchman, Salt Lake City, UT (US)

(72) Inventor: Andrew Hinchman, Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/848,597

(22) Filed: Mar. 21, 2013

(65) Prior Publication Data

US 2013/0205690 A1 Aug. 15, 2013

Related U.S. Application Data

(63) Continuation of application No. 13/329,996, filed on Dec. 19, 2011, now Pat. No. 8,590,258.

(51) Int. Cl.
*E04B 1/98* (2006.01)
*E04H 9/02* (2006.01)

(52) U.S. Cl.
CPC ..... *E04H 9/021* (2013.01); *E04H 9/02* (2013.01); *E04H 9/028* (2013.01)
USPC ..... 52/167.7; 52/167.3; 52/167.2; 52/167.1; 52/638; 52/167.8

(58) Field of Classification Search
USPC ..... 52/167.1, 167.2, 167.3, 167.4, 167.8, 52/741.1, 855, 834, 638, 167.7; 267/136, 267/140.13, 141.5; 248/901
See application file for complete search history.

(56) References Cited

U.S. PATENT DOCUMENTS

| | | | | |
|---|---|---|---|---|
| 6,244,577 | B1 * | 6/2001 | Bucholtz | 267/136 |
| 7,065,927 | B2 * | 6/2006 | Powell et al. | 52/167.3 |
| 7,188,452 | B2 * | 3/2007 | Sridhara | 52/167.3 |
| 7,373,758 | B2 * | 5/2008 | Tsai et al. | 52/834 |
| 8,590,258 | B2 * | 11/2013 | Hinchman | 52/741.1 |

* cited by examiner

*Primary Examiner* — Chi Q Nguyen
(74) *Attorney, Agent, or Firm* — Robert L. Shaver; Dykas & Shaver

(57) ABSTRACT

Disclosed is a buckling restrained brace which is a core plate inside a tube, with the plate prevented from buckling by being surrounded by the tube. The core plate is provided with a layer of discrete springs adjacent the core plate, with the interior of the tube otherwise filled with cement. The layer of discrete springs may be cardboard of other material. The layer of discrete springs defines a space between the core plate and the concrete, to allow for expansion of the core plate under compression from the ends.

11 Claims, 11 Drawing Sheets

BUCKLING-RESTRAINED BRACE

"This application is a continuation application of application Ser. No. 13/329,996, now U.S. Pat. No. 8,590,258, filed on Dec. 19, 2011, the disclosure of which is incorporated herein by reference."

FIELD OF THE INVENTION

The disclosed technology is a brace for use in construction of structures, and more particularly a brace for use in absorbing impact, explosive or seismic forces and making a building or structure more resistant to these forces.

BACKGROUND OF THE INVENTION

A buckling restrained brace (BRB) is typically used in buildings or other structures to brace them from earthquake or other lateral forces. They are placed diagonally in buildings and are seen as sloping diagonal members running from floor to floor, sometimes visible in the building windows. A BRB is a structural brace meant to resist compression, and designed to not buckle. All other braces will buckle, similarly to a drinking straw, if you push axially on the ends of it. A BRB separates the buckling behavior from the load carrying capacity. A simple experiment to demonstrate this behavior is to take a 20" long ⅛" diameter steel rod and compress it axially. Buckling of the rod will be seen with very little applied axial force (from the ends of the straws). Now take this same rod and place it through an 18" long ½" diameter steel pipe and apply an axial load and you will see it can now sustain orders of magnitude more force. The same experiment, on a less dramatic scale, could be done with a plastic straw and a section of ½" PVC pipe. The rod, the "load carrying element" (LCE), can now sustain more load because of the pipe the "buckling restraining element" (BRE). The LCE and BRE perform two independent but complementary roles. The LCE takes the force/loading only. The BRE only has to prevent the buckling and does not sustain any load. The LCE and BRE behaviors are bifurcated. On the other hand, a typical brace must carry load and prevent buckling with the same element.

A BRB takes this concept even further. If one can control the environment between the LCE and the BRE precisely enough you can distort the LCE's molecular structure. The LCE can be smashed axially in compression and then stretched in tension over and over until the material finally reaches its ductility limits. This is the same phenomenon as when you bend a paper clip. You can bend it back and forth for a while, but if you keep going it reaches its limits and breaks. The BRB LCE is similar, except instead of bending, it's smashing and stretching. It is worth mentioning that the BRE is not needed when the LCE is in tension. In tension mode, buckling is impossible. Thus in tension, the BRE is just along for the ride and it is only necessary when the BRB is being smashed in compression. The ability of the BRB to smash and stretch over and over again with relatively large displacements makes it possible to absorb large amounts of earthquake or other lateral forces much like a shock absorber.

All of the current producers use similar art. They all take a long slender rod, the LCE, which is typically called the "steel core" or "core plate" and pass it through a hollow steel tube or pipe. Once the core plate is placed through the pipe/tube, the annular space between the core plate and the pipe is filled with a rigid cementitious material, like concrete. The pipe and the concrete are called the "casing", which is the BRE. Thus, a BRB is basically a large steel rod (2" diameter for instance) passed through a 12" steel pipe that is centered in the pipe, with concrete filling the space between the rod and the pipe.

If the concrete were in intimate contact with the core plate, there would be no room for the core plate to expand as it is smashed from the ends. As the core plate expands it would press against the concrete, thus engaging the concrete and subsequently the pipe casing. This is the same reaction as a typical foam ear plug. If it is compressed from the two ends it gets fatter (thicker and shorter). The material has to move somewhere. The same thing happens to the core plate but not quite as dramatically. This is the crux of where the art between all the producers varies. You cannot just place the concrete up tight against the core plate. The main reason is because when the core plate smashes, the molecular structure must be relieved by expanding laterally. If the core expands and the concrete is tight, it will seize up against the concrete and transfer the load carrying duties to the concrete and pipe casing. Keep in mind that the concrete and pipe are only designed to prevent buckling and not to take any load. If those elements are also engaged in taking the load/force, they will tend to buckle. Thus great care must be taken such that the core has a zone of separation from the concrete, and the core plate is unbonded from the concrete, so it can move independently from the concrete, and can expand inside the concrete under compressive force. In other words, you need a small gap or layer of film between the core and the concrete to accommodate this behavior.

To further complicate this, if you leave too much gap between the core and the concrete, as the core smashes, it will try to buckle up against the concrete. This buckling behavior is denoted by a series of sinusoidal shaped waves. As the load on the core increases the number of equidistant waves also increases along the core plate length. This wave shaped core will impart transverse forces into the concrete and pipe that can degrade the concrete and cause the BRB to fail. Typically, if this behavior is not controlled, the concrete breaks out as well as the walls of the pipe or tube. The larger the gap between the core and the concrete the larger the amplitude of the buckling and the larger the transverse forces will be. Also, this behavior creates friction between the core and the concrete which decreases the quality of the performance by making its compressive capacity much larger than its tension capacity. This is undesirable in regulatory building codes because it causes the rest of the structure to be more robust and expensive than required. Thus the true art is how well you can control this environment between the core and the concrete, how economically you can do it and still achieve the highest performance standards. This is achieved by providing precise spacing around the core plate, neither too small nor too large, and unimpaired movement of the core plate inside the concrete, while utilizing minimal cost in materials and manufacturing. Doing such will provide the ability for the BRB to sustain repeated loads in multiple events most cost effectively.

One critical performance standard is the difference in what compressive force it takes to deform the BRB verses what force it takes to deform the BRB the same amount in tension. Remember that in tension the concrete and pipe are just along for the ride. But in compression the core tries to buckle up against the concrete, creating friction. Also remember that when the core smashes it swells (expands). This creates more area to smash which requires more force. In tension the core is not buckling against the concrete and it is shrinking, resulting in less resistance from contact with the concrete and less force required to stretch it. The manufacturers can't do anything about the swelling and shrinking of the core plate but they can reduce the friction against the concrete by controlling the amplitude of the equidistant sinusoidal buckling waves and by providing bearing materials between the core and the concrete. The closer the manufacturers can match the compressive and tension behaviors the lighter they can make the overall building structures. Thus creating a well controlled gap between the core and the concrete is essential for performance.

Another critical performance standard is how much the BRB can smash and stretch cumulatively. This is also improved by how well the gap is controlled between the core and the concrete. The smaller you can keep the amplitude of the sinusoidal buckling core or bending of it the more it can smash and stretch because less of its deformational capacity is used up in bending. But remember the gap cannot be too small or else the swelling of the core cannot be accommodated. Thus the gap needs to be optimized to allow for swelling of the core while keeping the amplitude of the buckling waves small.

Shridhara is an early patent in this technology. Shridhara's patent defines the interface between the core and the concrete as a "gap". The patent does not reveal how the gap is controlled nor does it even say how to create it during manufacture.

Nippon (Unbonded Brace) uses a "film" (reports are that it is really "ice and water shield" type roofing product) with the film having a large variance in secant modulus (Ratio of stress to strain at any point on curve in a stress-strain diagram. It is the slope of a line from the origin to any point on a stress-strain curve) from that of almost petroleum jelly to concrete.

CoreBrace uses a bearing material Ultra High Molecular Weight (UHMW) polymer (the base material on snow skis) between the core and concrete that is separated from the core via separators that are then removed after the concrete is placed, creating a gap. They are fairly precise about the bearing material, spacers and gaps it creates. They also have numerous other patents in regard to the device, one of which the inventor of this technology is listed as a co-inventor.

Star Seismic uses a metal sheet between the concrete and the core and then removes the sheet after the concrete solidifies, creating a gap. They also have several other patents in regard to other elements of the BRB.

When the core plate compresses or stretches a little, like a rubber band, it will spring back to its original shape. This called "elastic" behavior, hence the term "elastic" bands. However, at large deformations, the core plates will permanently distort and will not rebound to its original shape, which is called "plastic" behavior. When steel goes into its "plastic" behavior and the molecular structure is permanently distorted. So in compression the steel molecules flatten and spread out. In tension they lengthen and get thinner. This plastic behavior is why the region between the core plate and the concrete is so critical. This plastic behavior is also what absorbs the large seismic forces. These forces literally smash and stretch the BRB plastically back and forth acting like a fuse for the seismic energy.

BRIEF SUMMARY OF INVENTION

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept (s) in any way.

Disclosed is an improved BRB (Buckling restrained Brace) which improves upon the characteristics of prior art Buckling restrained Braces. The BRB of the disclosed technology includes a core plate with a first end and a second end. At each of the ends there is an attachment means which may be bolt holes through which securing bolts or rivets are placed. The attachment means may also be welding or single pins. The BRB is placed diagonally in buildings, typically to connect a vertical member to a horizontal member. The core plate can be cylindrical or rectangular in cross section, and has a generally a linear structure with a longitudinal axis.

The core plate has a mid section which is surrounded by a casing tube. The mid section can be of various lengths, and typically is encased in the casing tube with the first end and the second end extending outside of the casing. The casing tube typically would be a square or round tube made of steel. The casing tube would additionally have a first end plate and a second end plate which surround the core plate and seal the ends of the casing tube.

Adjacent to the core plate, on the portion inside the casing, is a layer of discrete springs which covers some or all surfaces of the core plate. The discrete springs are a layer of resilient (elastically behaving) or degrading (plastically behaving) spacing members in close proximity or in contact with the core plate. The layer of discrete springs has an outer surface and the area between the outer surface of the discrete springs and the inner surface of the casing tube, and is filled with a cementitious material, such as concrete or grout.

The layer of discrete springs provide a space so that when pressure is applied to the ends of the first end and the second end of the core plate, the material of the core plate may be compressed and expand laterally without contacting the grout matrix. In this way, the core plate is allowed to absorb the force of lateral loads without compromising the grout layer or the casing tube. The disclosed technology uses this layer or series of "discrete springs" between the core and the concrete which are attached to the core plate and which stay in place after the concrete solidifies. Thus it is not a "gap" nor is it a "film", but it defines a space surrounding the core plate filled with discrete deformable material.

One type of discrete springs that may be used is a structure of corrugated metal sheet which is pressed against the core plate, and which has flat metal sheet outer surface on the concrete side, to keep the corrugations from filling with liquid concrete when the concrete is placed in the casing tube. Corrugated paper is another suitable material for use as a discrete spring layer. The discrete spring's layer could also be made of almost any polymer.

The technology operates so that when the core plate smashes (expands) and buckles, the discrete spring layer gives way, permitting the swelling of the core plate. The discrete spring layer also defines the size of the gap between the core plate and the inside of the concrete. Corrugated metal would be useful if the concrete is placed in the BRB when it is in a vertical orientation, as the pressure of the liquid concrete near the bottom end of a full BRB can be quite significant and in that orientation the discrete springs layer need to withstand that pressure or else they would collapse and then the concrete would be tight to the core plate, which is not good as explained in this document. If the brace is oriented generally horizontally when the liquid concrete is applied, the pressure from the liquid concrete would be minimal. The BRB could be tilted up a little during placement of the concrete, and thus the pressures due to the depth of the liquid above the bottom would be minimal. In such a horizontal pouring ordinary cardboard or corrugated plastic could be used as the "discrete spring" layer. The use of a layer of cardboard as the discrete spring layer also has significant economical advantages. Obviously, it cost less than UHMW, removable separators, ice & water shield and steel sheets. These systems (UHMW, removable separators, ice & water shield and steel sheets) also require mechanical fastening and sealing to keep them in place during concrete placement and to not let the concrete infiltrate between them and the core plate. Cardboard is easier to fabricate and easier to install, as it can be coated with adhesive and placed on the core plate, and then the concrete is poured/placed around it. The precision of the fit the cardboard around the core plate is not as critical, which increases permissible tolerances, making fabrication even easier. Also, the cardboard does not need to completely cover the core plate as long as it is sufficiently covered to accommodate the swelling of the core plate, thus requiring less material and fabrication time. For instance, cardboard could cover only one side of the core plate, and still provide the exact spacing required. Another major advantage of corrugated material verses some of the other technologies is that it can be fit to core plates with round cross sectional shapes since corrugated material can be bent transverse to its' corrugations.

If the core plate is a long steel bar with a rectangular cross sectional shape of a certain width and thickness, the cardboard discrete spring's layer has to cover at least the width on one side and the thickness on one edge. It can overhang some which increases the permissible tolerance the width that cardboard must be cut to.

Also as the BRB operates, the cardboard material will actually behave much like small bearings as it disintegrates, decreasing friction between the core plate and the concrete, thus improving performance.

Another option is to use spray foam where a collapsible material is needed where the core plate transitions to the end connections.

Tape or shrink wrap are also options for adhering the cardboard to the core plate. Cardboard can be purchased in a variety of thicknesses, and can be placed on one or both sides of the core plate, depending on how much thickness is needed for a particular application. The larger the cross sectional area of the core plate, the more it swells. Thus the thicker the cardboard needs to be or the more layers of cardboard that needs to be placed.

Testing has shown that a BRB made to the disclosed technologies is capable of sustaining multiple events. In the disclosed technologies, the deformation is isolated in the BRB and its durability indicates that structures utilizing the disclosed technologies would be damaged less than other conventional structural systems that rely on the beams to deform or a conventional brace to buckle. Typically the beams and braces in structures not utilizing this disclosed technology will require repair and most likely replacement after a seismic or other similar event. Beams are not easy to fix since they hold the floors up. In a building or other structures utilizing BRBs, since most of the deformation is limited to the core plate of the BRB, the beams are typically still OK after a seismic event as well as the BRBs.

There are typically stiffener plates at the ends of the core plates, and a compression region at the transition edges of the stiffer plates. Styrofoam, spray foam or other collapsible material could be used at the compression region at the transition edges of the stiffener plates. This collapsible material needs to be stiff enough to not deform during grout placement but soft enough to easily collapse with negligible resistance when the BRB deforms in compression. It needs to have a majority, about 50% or more, of its structure be comprised of voids that will allow it to collapse on itself.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE INVENTION

Figure 1:
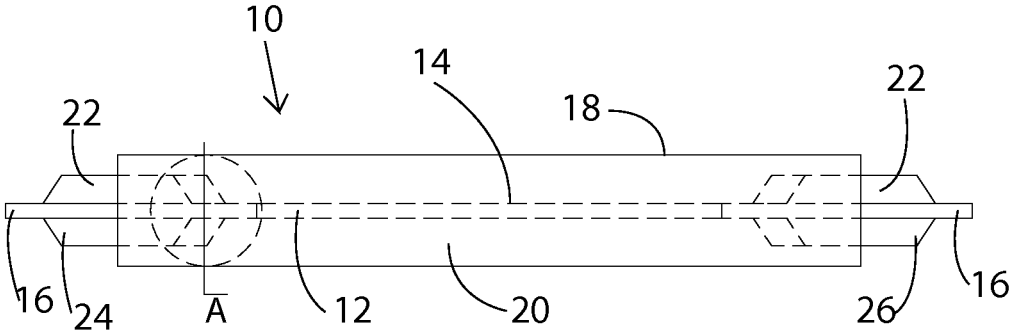
FIG. 1 is a side view of one embodiment of the disclosed BRB.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Shown in FIGS. 1 through 19 are several preferred embodiments of the Buckling restrained Brace of the disclosed technology. FIG. 1 shows the BRB 10 of the disclosed technology, including the core plate 12, a discrete spring layer 14, attachment means 16 on the ends of the core plate 12, the casing tube 18 and the grout matrix 20. Shown in FIG. 1 are stiffeners 22 which are attached at a first end 24 and a second end 26 of the core plate 12. The stiffeners 22 may be attached in a number of ways, with one preferred way being to weld the two stiffeners 22 to either side of the core plate 12.

As a general example, Buckling restrained Braces may be from 1 to 100 feet in length, with 25 feet being an average size. The core plate 12 is preferably made of steel (although aluminum and other materials may work as well). For a Buckling restrained Brace of this typical size, the core plate 12 would be generally rectangular, 300 inches in length, 8 inches wide and 1.25 inches in thickness, and made of steel. Shapes other than rectangular would also work and are considered within the scope of the claims, such as round in cross section, cross in cross section, or other shapes.

The discrete spring's layer 14 would preferably be made of corrugated paper (cardboard), corrugated plastic or corrugated metal. One of the advantages of using cardboard is that it could be almost any shape and it can conform to core plates with round cross sectional shapes.

Figure 2:
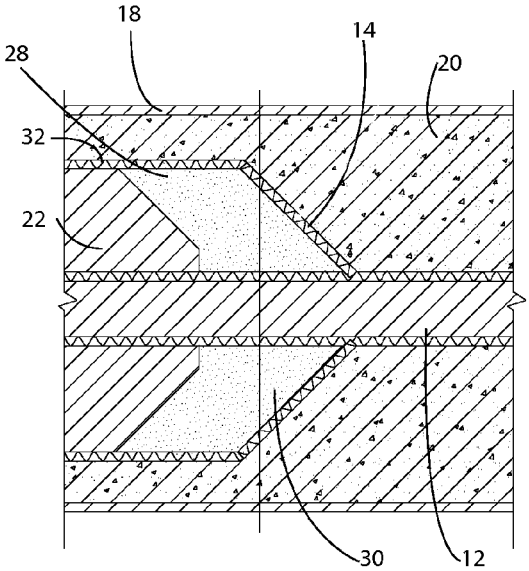
FIG. 2 is a partial cut section detail of part of the BRB of FIG. 1.

FIG. 2 shows greater detail the circled portion of FIG. 1, with the discrete spring's layer 14 more clearly shown. Shown in FIG. 2 is the Buckling restrained Brace 10 shown in detail along the longitudinal axis. It includes a core plate 12, a discrete spring layer 14, casing tube 18 and grout matrix 20. FIG. 2 shows a compression zone 28 which may be filled with a collapsible material 30. The collapsible material 30 can be expanded or extruded polystyrene, or spray foam insulation, honey combed paper construction or similar material or even just formed void. A preferred material which may be used as a discrete spring's layer 14 is corrugated paper 32. The corrugated paper may be placed on one side of the core plate only, if the thickness of the corrugated paper provides sufficient thickness for projected expansion of the core plate under compression. The corrugated paper may be affixed to the core plate 12 by an adhesive layer or by mechanical means, such as tape, shrink wrap, clamps, extruded clamps, etc.

The casing tube 18 is typically made of steel and can be square or round, with both of those shapes being preferred shapes. A wall thickness of 5/16 inches for the casing tube is typical, with a common range in wall thickness being 3/16 to 3/4. This would vary greatly depending on the specific situation in which the BRB is used.

When a seismic or other event with lateral forces occurs, an axial compressive force is placed on the first end 24 and the second end 26 of the core plate 12. At that time, the core plate is compressed and it expands in size. When the core plate is compressed, the stiffeners 22 move into the compression zone 28 shown in FIG. 2, and compress the collapsible material 30 that is present in those spaces. As the core plate 12 expands, the discreet spring layer is compressed in response and accommodates the thicker dimensions of the core plate.

Figure 3:
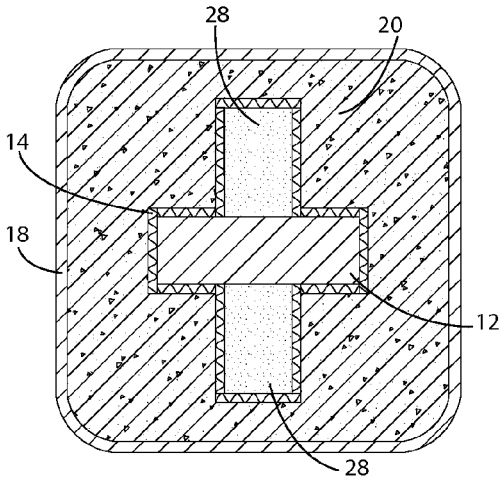
FIG. 3 is a cross section of part of the BRB of FIG. 1.

Shown in FIG. 3 is a cross section of the Buckling restrained Brace (BRB) 10 of the disclosed technology, at the location shown in FIG. 1 as section line A. Shown in FIG. 3 is a casing tube 18 of square material such as steel, with a typical wall thickness of 5/16 inches. FIG. 3 also shows the core plate 12 with all surfaces of the core plate 12 surrounded by a discrete spring layer 14. Also shown is the compression zone 28 which is provided for movement of the stiffeners 22 as the core plate is compressed. The region between the discrete spring layer 14 and the casing tube 18 is filled by grout matrix 20. The grout matrix can be composed of any material of sufficient stiffness and ordinary cementitious grout is the preferred material. Ordinary cementitious grout is a blend of Portland Cement, sand, gravel, and is formed by adding water to the dry components. The BRB 10 of the disclosed technology is capable of sustaining multiple seismic or lateral load events without replacement, until the metallurgical characteristics of the core plate 12 are compromised, and or the grout and casing are compromised.

Figure 4:
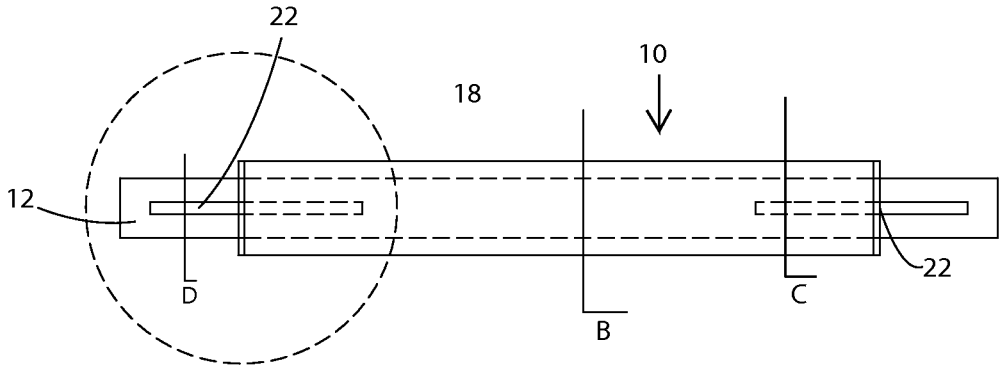
FIG. 4 top view of one embodiment of the disclosed BRB.

FIG. 4 is a top view of an embodiment of the BRB of the disclosed technology. It includes a core plate 12, stiffeners 22 attached at the two ends of the BRB, a casing 18.

Figure 5:
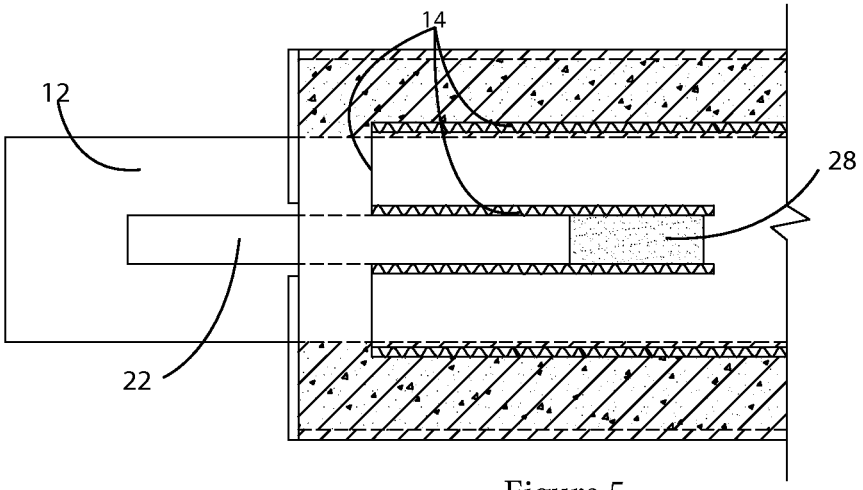
FIG. 5 is a partial cut section detail of part of the BRB of FIG. 4.

FIG. 5 shows a compressible zone 28 which will be filled with collapsible material so that when the core plate 12 and the stiffeners 22 are compressed from the ends, the stiffeners have an area in which to enter. Also the compressible zone is typically surrounded by the discrete spring layer 14 to help secure it. It can also be secured directly with adhesive, tape, etc.

Figure 6:
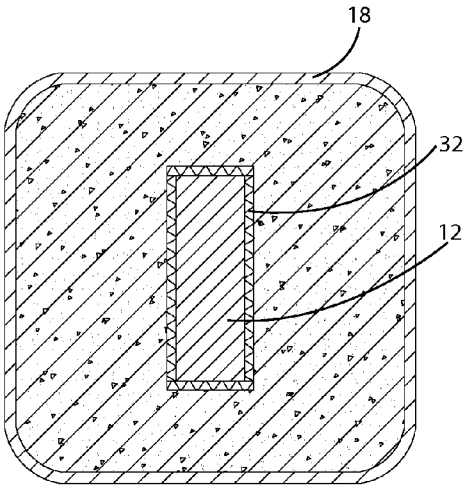
FIG. 6 is a cross section of part of the BRB of FIG. 4.

FIG. 6 shows a cross section at B of FIG. 4, showing the core plate 12, surrounded by cardboard 14 with those surrounded by concrete and the casing tube 18.

Figure 7:
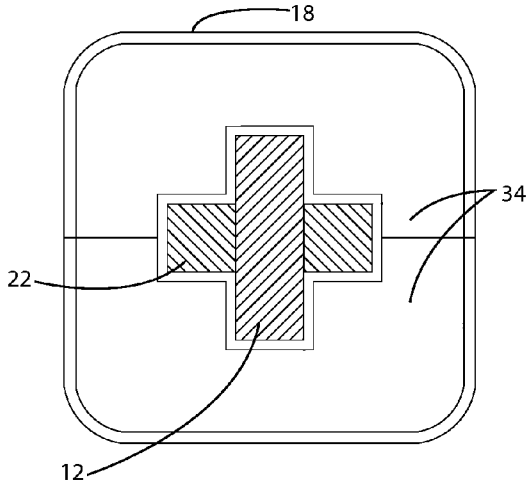
FIG. 7 is an end view of the BRB of FIG. 4.

FIG. 7 shows an end view at section D of the embodiment shown in FIG. 4, with the end plate 34 being visible, as well as the core plate 12, the stiffeners 22 and the outside of the casing 18.

Figure 8:
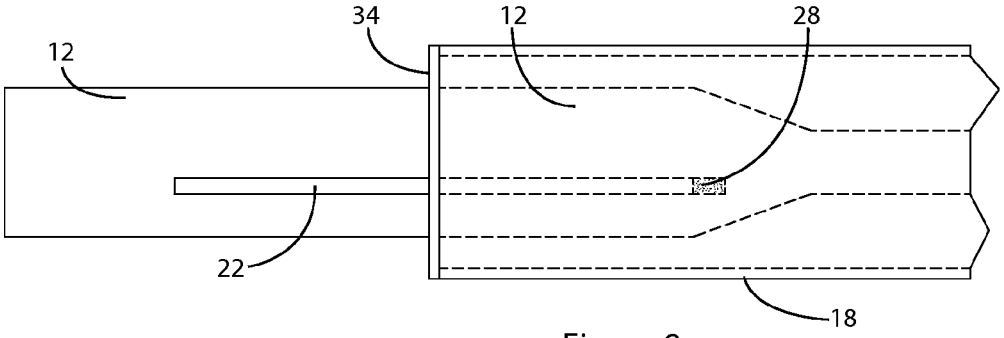
FIG. 8 is a partial top view detail of the BRB of FIG. 4.

FIG. 8 is a view of an alternative embodiment of the invention, in which the core plate 12 has a wider paddle-like portion towards the end, with a stiffener 22 attached to it, which extends into the concrete inside the casing tube 18. The variant shown in FIG. 8 would have a compressible space along the edges of the tapered portions of the core plate. This wider portion of the core plate provide for more bearing area of the core plate against the grout where the stiffeners 22 terminate inside the casing. For very narrow core plates there would not be sufficient width for support against the grout on both sides of the stiffener compression zone 28 unless it is widened as such. Without sufficient support, the core plate could buckle in the compression zone region and lead to early degradation of the core plate at this location and thus cause a potential for premature failure of the entire BRB.

Figure 9:
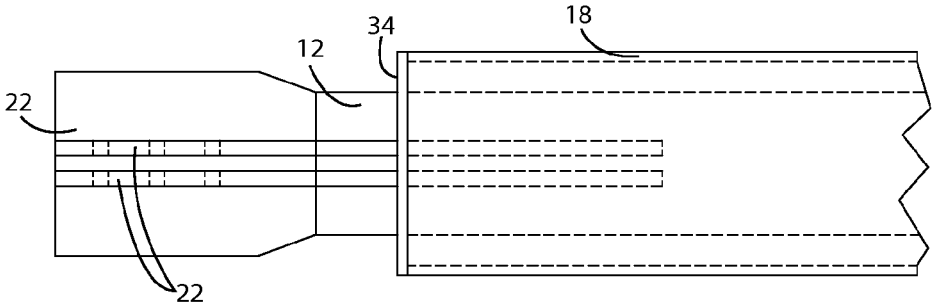
FIG. 9 is a partial top view detail of an embodiment of the disclosed BRB.

FIG. 9 is an alternative embodiment of the invention in which two stiffeners are attached to the core plate 12, with each of the stiffeners having holes which serve as the attachment means for this embodiment. This version is similar to the version shown in previous figures, in that a discrete spring's layer and compressible spaces would be present.

Figure 10:
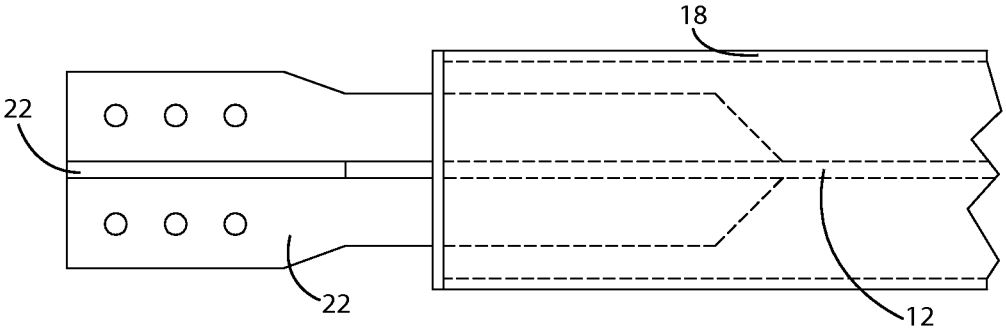
FIG. 10 is a partial view of an embodiment of the disclosed BRB.

FIG. 10 is a view of the embodiment shown in FIG. 9, shown at 90 degrees from the view in FIG. 9.

Figure 11:
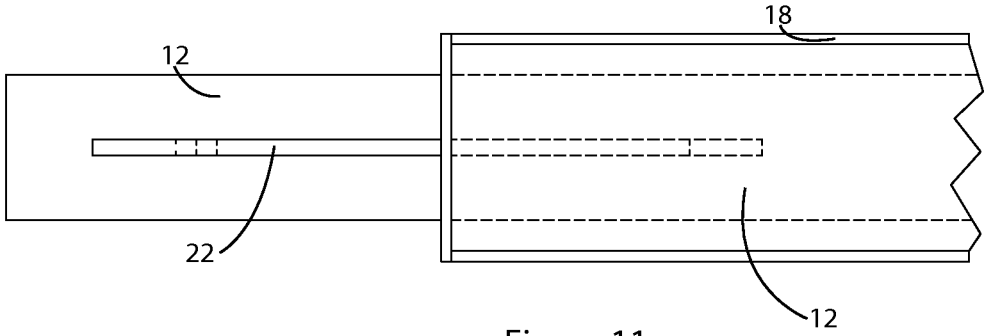
FIG. 11 is a partial top view of the embodiment of FIG. 10.

FIG. 11 is an alternative embodiment of the BRB 10 of the invention, with a different configuration of stiffener plate 22 attached to the core plate 12. This version is similar to the version shown in previous figures, in that a discrete spring's layer and compressible spaces would be present.

Figure 12:
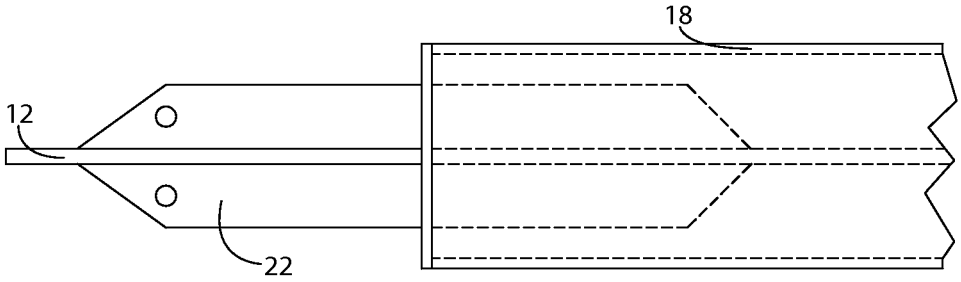
FIG. 12 is a partial side view of an embodiment of the disclosed BRB.

FIG. 12 is a top view of the embodiment shown in FIG. 11.

Figure 13:
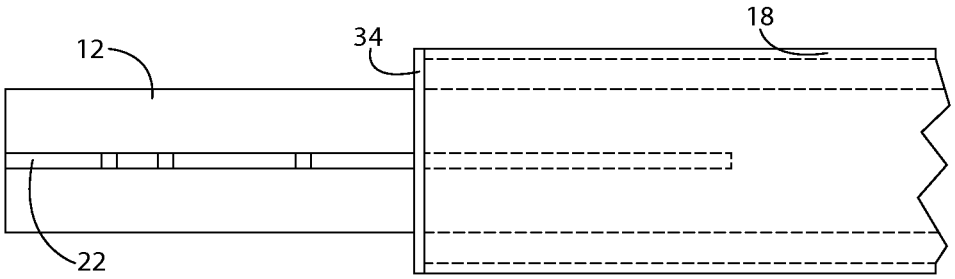
FIG. 13 is partial top view of an embodiment of the disclosed BRB of FIG. 12.
Figure 14:
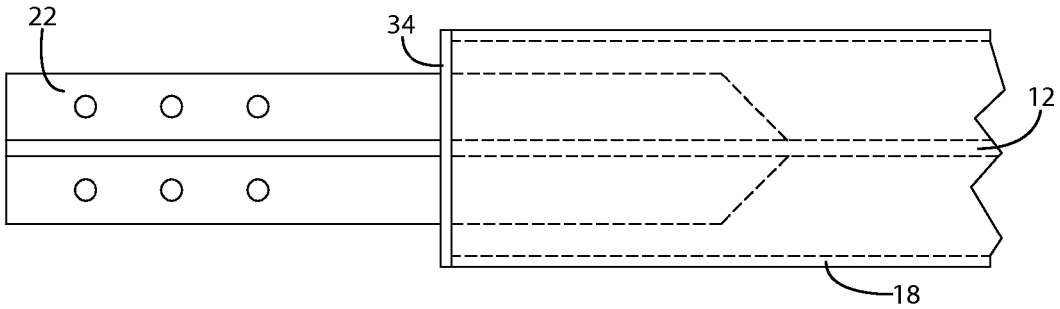
FIG. 14 is a partial side view of an embodiment of the disclosed BRB.

FIG. 13 is a side view of an embodiment of the BRB of the invention, with a stiffener plate 22 which extends to the end of the core plate 12, and which extends into the interior of the casing tube 18. FIG. 14 is a top view of the embodiment shown in FIG. 13. This version is similar to the version shown in previous figures, in that a discrete spring's layer and compressible spaces would be present.

Figure 15:
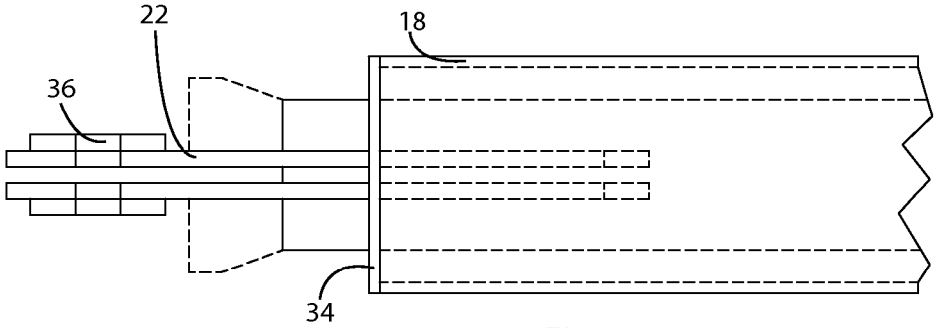
FIG. 15 is a partial top view of the embodiment of the disclosed BRB of FIG. 14.

FIG. 15 is a view of an alternative embodiment of the BRB of the invention, which includes multiple stiffeners 22, with each stiffener having a plate 36 which reinforces the hole where the stiffener is attached to its anchor point.

Figure 16:
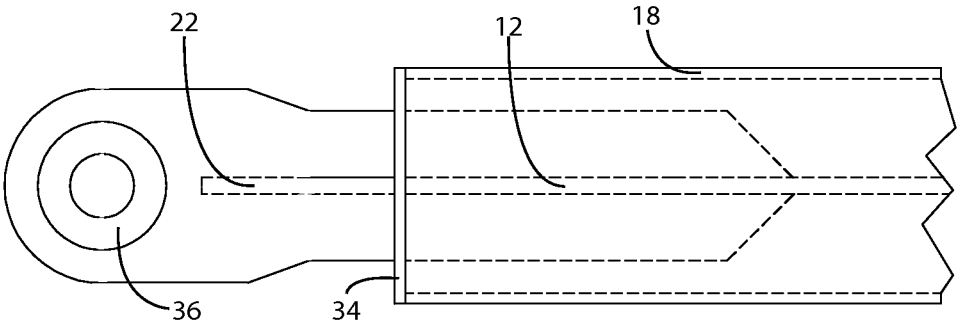
FIG. 16 is a partial side view of an embodiment of the disclosed BRB.

FIG. 16 is a side view of an embodiment shown in FIG. 15.

Figure 17:
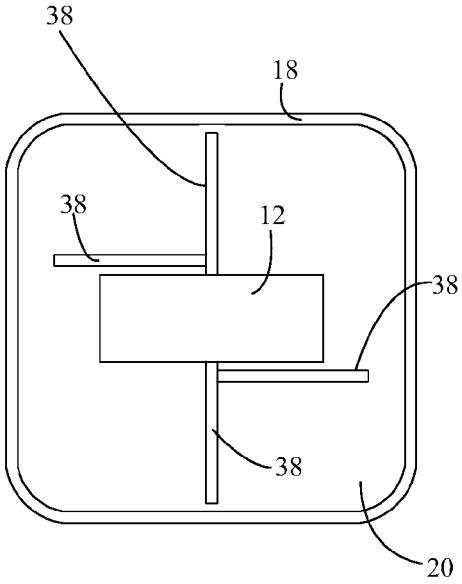
FIG. 17 is a cross sectional view of an embodiment of the disclosed BRB showing dowels and stops.

FIG. 17 is a cross sectional view of the BRB showing positioning stops 38. The stops 38 may be present in any of the embodiments shown. They are steel plates attached (typically welded) to the core plate 12 at the midpoint of the core area, and anchor the core plate to the grout at the midpoint. Since the core plate is compressed from both ends, the center of the core plate is relatively stationary during compression. Anchoring the core plate to the concrete at the center thus does not impart stress to the concrete. The stops typically do not touch the casing 18, and end about ⅛" inches from the inner surface of the interior of the casing. The stops are typically small steel plates (¼"×2"× about 3 to 4" long). A stop 38 is required to keep the core's position in the casing 10 and hardened grout 20. Without the stop, the casing can move transversely or longitudinally down and bottom out on the connection 40 or the compressible material 30 at the core transition zone 28, when put in place. This isn't necessarily a problem since the BRB ends, the portion extending outside the end of the casing, are designed for stability even in this worst case scenario. It is more of a service issue and how the BRB looks when it is in place. If these plates are long enough (the distance between the core and casing) they can be used to position the core transversely as well. If attached near the center of the core, more significant stress risers can be avoided if they were attached at the thin edge of the core plate. Stress risers occur when there is a change in the shape of the core plate and the stress in the core plate material is redistributed across the change is shape location. Stress risers at the thin edge of the core plate can initiate earlier fracture of the core when it undergoes an event. The presence of positioning stops 38 does not cause problems with the grout fracturing. The grout is completely confined by the casing, so even if minor cracks occurred, the grout stays intact.

Figure 18:
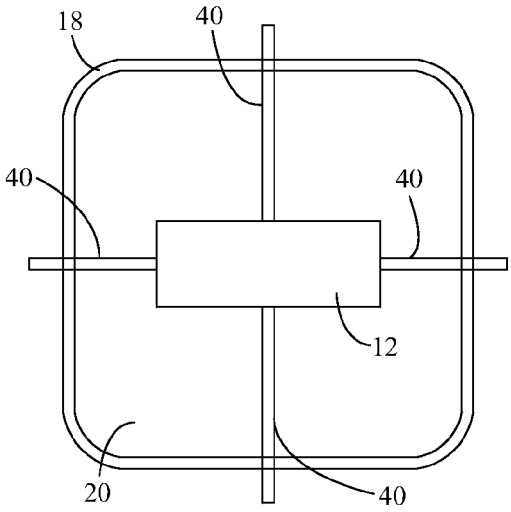
FIG. 18 is a cross sectional view of an embodiment of the disclosed BRB showing dowels.

FIG. 18 is a cross section view of an embodiment of the BRB showing positioning dowels 40. The positioning dowels 40 are placed as needed to maintain the core's 12 transverse position in the casing. BRBs with short stout cores would not need the positioning dowels. Long slender core BRBs would need dowels about every 10'. The dowels are typically a steel rod or pipe ¼" to ½" in diameter and 3" to 12" long. Typically a hole is drilled through the casing 10 through which the dowels are passed. The dowels are measured and marked so that when they are passed through the casing they will be stopped when the mark aligns with the outside face of the casing. The positioning dowels 40 are welded to the casing 18, and typically cut off flush with the outside surface of the casing 18. FIG. 18 shows positioning dowels before they are cut off. This way the gap between opposing dowels at the core plate will be insured to not be too tight to the core plate nor too large so that the core plate can deflect too much. Typically the dowels are positioned to be on opposing positions on the core plate. The dowels do not anchor to the core plate, but are spaced apart from the core plate. The gap between the ends of the positioning dowels and the core is no smaller than the thickness of the discrete spring layer 14 nor wider than about ¼". An alternative to measuring and setting the dowel is to place a very stiff thin bearing plate (not shown) on the discrete spring layer 14 that the dowel can rest against. Typically this bearing plate would be made of steel plate about ¼" in thickness and about 2" wide and about 2" thick. This bearing plate will prevent the dowel from possibly compressing the discrete spring layer during assembly and prevent the core plate 12 and positioning dowel from touching each other.

Figure 19:
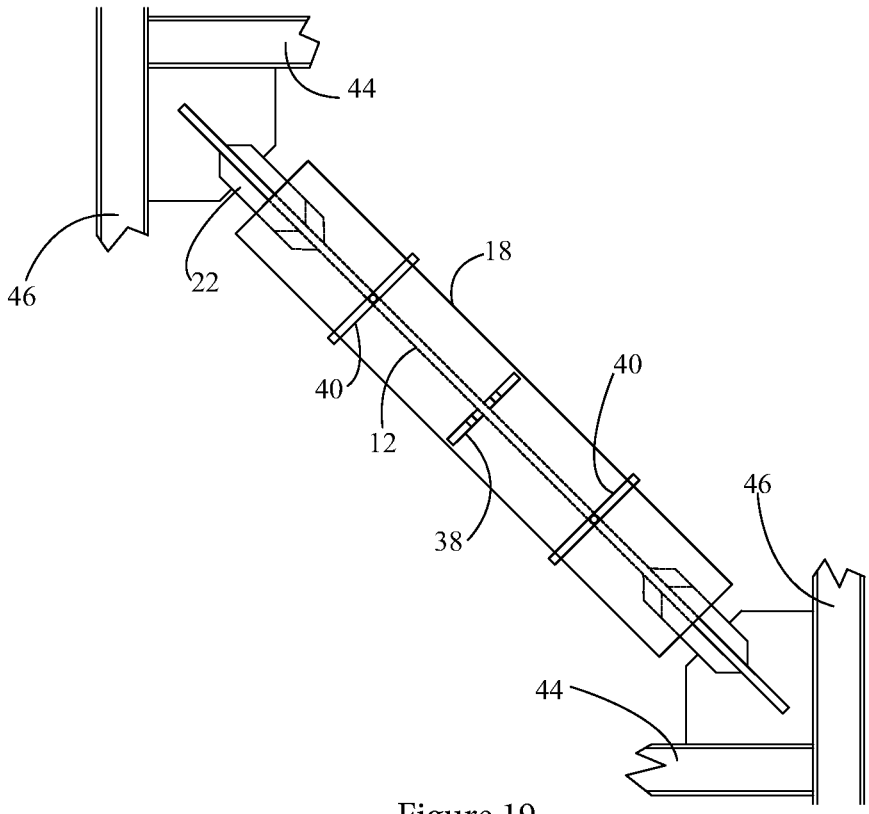
FIG. 19 is an elevation view of an embodiment of the disclosed BRB in a structure showing stops and dowels.

FIG. 19 is a figure showing the placement of positioning stops 38 and positioning dowels 40 in a typical BRB installation to beams 44 and columns 46. If the core plate is permitted to be displaced laterally along its length during grout placement, the core plate will induce transverse forces against the grout and will cause bending forces in the BRE, both of which could cause premature failure of the BRB.

Also disclosed is a method making the BRB. The method comprises the steps of cutting the casing tube or pipe to length. Lengths can vary, with about 20 feet being a typical length, with a tube that can vary in diameter or width with about 12" being a typical width or diameter, and of square or round tubing. After cutting, the positioning stop devices ("stops") are attached. These are short steel bars, and are attached at the mid length point of the core plate typically by welding. The stops at typically about ¼" to ½" thick 1" wide and 3" to 10" long. These stops are securely anchored to the core plate 12 and positioned so that will rest closely against the casing, keeping the core plate and casing centered on each other once the grout is placed and keeping the core plate's position transversely in the casing. This keeps the core straight along it's longitudinal axis avoiding larger bending forces and transverse forces that would occur if the core were not kept close to straight. The stops are also secured near the center of the core transversely to avoid stress concentrations near the edges of the core plate that could lead to earlier degradation of the core plate if they were attached near or at the thinner side of the core plates. At this time the core stiffener plates are also attached or other elements required to make the connection of the BRB to the structure.

At that point in the process a material such as cardboard is affixed to the core plate as a discrete spring layer. Then the core plate is placed inside the casing tube which is typically in a horizontal position. At one end of the casing the casing end plates are placed on the casing, preferably by welding. These end plates are required to keep the grout form flowing out the bottom end when it is placed. The casing end plate also maintains the core's transverse position in the casing. Also at this point on half of the casing endplates may be place at the other end of the BRB casing. This end plate helps keep the core plate's transverse position as well as keep less grout from spilling out as the casing is filled.

At this point the positioning dowels are placed through the casing close to the core as needed to keep the core plate's transverse position and close to straight longitudinally. The ends of the dowels are typically not any closer to the core than the thickness of the discrete spring layer nor more than about ¼" from the core. The dowels are measured and marked prior to placing them through the casing so when the mark aligns with the outside of the casing the gap between the end of the dowel and the core is correct. Alternatively a small stiff bearing plate can be placed between on the discrete spring layer and the dowel. It can be secured with adhesives, tape, clamps or clips. These dowels are typically steel rods or pipe about ¼" to ½" in diameter and 3" to 12" long. These dowels are secured to the casing typically by welding so they cannot move during grout placement. Shown in FIG. 18 is an example of dowel placement. The ends of the dowels on the outside of the casing can be cut or ground smooth to the casing for esthetics if desired.

The BRB is then propped up slightly at the open end side for grout placement. The casing tube is then filled with grout. After the grout has cured the upper end is packed with stiff grout that has very little slump to fill any voids and then the last casing end plate(s) are attached to the casing tube fill casing tube. Alternatively a shroud can be placed at the end of the BRB casing where the grout is entering the casing from that fits tight to the ends of the BRB so grout leaking between the shroud and BRB end can be limited. Once the grout reaches the top most corner of casing the last casing end plate can be slide through the grout and secured thus eliminating the need to dry pack the grout. While the grout is still wet the shroud can be removed and the grout can be cleaned from the end of the BRB.

While certain exemplary embodiments are shown in the Figures and described in this disclosure, it is to be distinctly understood that the presently disclosed inventive concept(s)

is not limited thereto but may be variously embodied to practice within the scope of the following claims. From the foregoing description, it will be apparent that various changes may be made without departing from the spirit and scope of the disclosure as defined by the following claims.

The invention claimed is:

1. A buckling restrained brace comprising:

a generally elongated core plate with a first end and a second end and a longitudinal axis, and a medial region, with an attachment means on each end of said core plate, with said core plate configured to sustain compression forces and tensile forces from said ends;

a discrete spring layer of corrugated material surrounding some or all surfaces of at least said medial region of said core plate, with said discrete spring layer comprising a spacing and resilient or degrading material in sliding engagement with said core plate, with said discrete spring layer defining a zone of compression around said core plate and providing a standoff spacer layer from a liquid grout matrix which is configured to solidify to surround said discrete spring layer with solidified grout, and providing a space for transverse expansion of said core plate;

a casing tube enclosing said core plate and spaced apart from said core plate, with said casing tube configured to sustain expansion forces and prevent said core plate from buckling, said casing tube further comprising a first end plate and a second end plate, with said end plates defining a core plate passage for passage of said core plate through said end plates;

said liquid grout matrix positioned between said discrete spring layer and said casing tube;

with said discrete spring layer providing a resilient or degrading and displaceable layer and an expansion space for expansion of said core plate, and with said casing tube and liquid grout matrix serving as a buckling restraining element if sufficient force is applied to said ends of said core plate, and with said core plate configured to absorb seismic shocks or other forces in tension and in compression, with said casing structure limiting said core plate tendency to buckle.

2. The buckling restrained brace of claim 1 wherein said corrugated material is a metal corrugated material.

3. The buckling restrained brace of claim 1 wherein said corrugated material is a plastic corrugated material.

4. The buckling restrained brace of claim 1 wherein said discrete spring layer is comprised of a layer of corrugated cardboard.

5. The buckling restrained brace of claim 1 wherein said attachment means is at least one chosen from the attachment means comprising bolts and bolt holes, a single pin or welds.

6. The buckling restrained brace of claim 1 which further comprises one or more generally planar stiffeners attached to said ends of said core plate at an angle generally normal to said core plate.

7. The buckling restrained brace of claim 6 in which planar stiffeners are surrounded by a discrete spring layer internal to said casing tube on some or all surfaces.

8. The buckling restrained brace of claim 6 wherein said liquid grout matrix further defines a void consistent in shape and adjacent to said one or more stiffeners.

9. The buckling restrained brace of claim 8 wherein said void is surrounded by a discrete spring layer on some or all surfaces.

10. The buckling restrained brace of claim 6 wherein said stiffeners extends through said casing end plates and into said concrete matrix and are bounded by said a discrete spring layer on some or all surfaces of said stiffeners where said liquid grout matrix occurs.

11. The buckling restrained brace of claim 1 wherein said core plate further comprises a first and second end which are wider than said medial region of said core plate and which are surrounded by a discreet spring layer internal to the casing tube on some or all surfaces.

* * * * *